US011305410B2

(12) United States Patent
Yeh et al.

(10) Patent No.: US 11,305,410 B2
(45) Date of Patent: Apr. 19, 2022

(54) STAPLE GUN

(71) Applicant: PAO SHEN ENTERPRISES CO., LTD., Chang Hua (TW)

(72) Inventors: Sheng-Lung Yeh, Chang Hua (TW); Chun-Man Lai, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 41 days.

(21) Appl. No.: 17/037,866

(22) Filed: Sep. 30, 2020

(65) Prior Publication Data

US 2022/0055195 A1 Feb. 24, 2022

(30) Foreign Application Priority Data

Aug. 21, 2020 (TW) ..... 109128623

(51) Int. Cl.
*B25C 5/00* (2006.01)
*B25C 5/16* (2006.01)
*B25C 5/11* (2006.01)

(52) U.S. Cl.
CPC ..... *B25C 5/1693* (2013.01); *B25C 5/11* (2013.01)

(58) Field of Classification Search
CPC ..... B25C 5/00; B25C 5/11; B25C 5/1693
See application file for complete search history.

(56) References Cited

U.S. PATENT DOCUMENTS 2,754,515 A * 7/1956 King ..... B25C 5/06 227/132
2,755,474 A * 7/1956 Spencer ..... B25C 5/0285 227/124
6,634,537 B2 * 10/2003 Chen ..... B25C 5/00 227/119
6,698,642 B2 * 3/2004 Chen ..... B25C 5/06 227/120
7,290,693 B2 * 11/2007 Cheng ..... B25C 5/06 227/29
7,540,400 B2 * 6/2009 Zins ..... B25C 1/008 227/108
7,571,843 B2 * 8/2009 Kumayama ..... B25C 5/0242 227/120
7,950,558 B2 * 5/2011 Marks ..... B25C 5/11 227/132
8,915,416 B2 * 12/2014 Huang ..... B25C 5/1658 227/109
8,978,952 B2 * 3/2015 Marks ..... B25C 5/0235 227/132
10,307,902 B2 * 6/2019 Wang ..... B25C 5/11
(Continued)

*Primary Examiner* — Thanh K Truong
*Assistant Examiner* — David G Shutty
(74) *Attorney, Agent, or Firm* — Burris Law, PLLC

(57) ABSTRACT

A staple gun is adapted for driving out a frontmost staple of a staple strip and a frontmost press piece of a press piece strip simultaneously. The staple gun includes a casing unit adapted for receiving the staple strip and the press piece strip, a striker unit adapted for striking the frontmost staple and the frontmost press piece out of the casing unit through an exit opening, and a loading unit including a staple holder, a press piece pusher that is adapted to abut against a rear end of the press piece strip, and a press piece spring that is connected between the press piece pusher and the staple holder for maintaining contact between the press piece strip and a front portion of the casing unit.

7 Claims, 15 Drawing Sheets

(56) References Cited

U.S. PATENT DOCUMENTS

| | | | | |
|---|---|---|---|---|
| 10,639,778 | B2 * | 5/2020 | Wang | B25C 5/1617 |
| 10,759,033 | B2 * | 9/2020 | Lai | B25C 5/11 |
| 11,065,751 | B2 * | 7/2021 | Wang | B25C 5/06 |
| 11,141,849 | B2 * | 10/2021 | Ferris | B25C 7/00 |
| 2008/0156844 | A1 * | 7/2008 | Braganza | B25C 5/06 227/109 |
| 2012/0118933 | A1 * | 5/2012 | Zheng | B25C 5/06 227/120 |
| 2020/0189083 | A1 * | 6/2020 | Hu | B25C 5/06 |

* cited by examiner

STAPLE GUN

CROSS-REFERENCE TO RELATED APPLICATION

This application claims priority of Taiwanese Patent Application No. 109128623, filed on Aug. 21, 2020.

FIELD

The disclosure relates to a hand-held tool, and more particularly to a staple gun.

BACKGROUND

A conventional staple gun is used for driving out staples to fasten a piece of paper (e.g., a flyer) to the wall. However, since the contact area between the each staple and the paper is small, corners of the paper can be easily removed from the wall by wind. As such, the staples are susceptible to become loose and may eventually fail to hold the paper on the wall.

SUMMARY

Therefore, the object of the disclosure is to provide a staple gun that can alleviate the drawback of the prior art.

According to the disclosure, a staple gun is adapted for driving out a frontmost staple of a staple strip and a frontmost press piece of a press piece strip simultaneously. The staple gun includes a casing unit, a striker unit, a handle unit and a loading unit.

The casing unit defines a staple room, a press piece room and an exit opening. The staple room is elongated in a front-rear direction, and is adapted for receiving the staple strip such that the frontmost staple abuts against a front portion of the casing unit. The press piece room is elongated in the front-rear direction, is disposed under and in spatial communication with the staple room, and is adapted for receiving the press piece strip such that the frontmost press piece abuts against the front portion of the casing unit and is disposed under the frontmost staple. The exit opening is formed at a bottom end of the casing unit, that is in spatial communication with the press piece room, and is adapted to be disposed under the frontmost press piece.

The striker unit is movably mounted to the casing unit, and is adapted for striking the frontmost staple and the frontmost press piece out of the casing unit through the exit opening.

The handle unit is mounted to the casing unit, and is operable to drive the striker unit.

The loading unit includes a staple holder, a staple pushing subunit and a press piece pushing subunit.

The staple holder is received in the staple room, and has two side walls, a bottom wall, a connecting member and a pulley member. The side walls are elongated in the front-rear direction and are opposite to each other in a left-right direction perpendicular to the front-rear direction. The bottom wall is elongated in the front-rear direction, is connected between the side walls, and has front and rear ends that are opposite to each other in the front-rear direction. The connecting member is disposed at the rear end of the bottom wall. The pulley member extends through the side walls in the left-right direction, and is proximate to the front end of the bottom wall.

The staple pushing subunit includes a staple pusher and a staple spring. The staple pusher is mounted to the staple holder, is movable relative to the staple holder along the front-rear direction, and is adapted to abut against a rear end of the staple strip. The staple spring has opposite ends that are respectively connected to the staple pusher and the connecting member of the staple holder, and extends around the pulley member such that the staple spring exerts a biasing force onto the staple pusher, thereby maintaining contact between the staple pusher and the staple strip and between the frontmost staple and the front portion of the casing unit.

The press piece pushing subunit includes a press piece pusher and a press piece spring. The press piece pusher is mounted to the bottom wall of the staple holder, is movable relative to the staple holder along the front-rear direction, and is adapted to abut against a rear end of the press piece strip. The press piece spring has opposite ends that are respectively connected to the press piece pusher and the connecting member of the staple holder, and extends around the pulley member such that the press piece spring exerts a biasing force onto the press piece pusher, thereby maintaining contact between the press piece pusher and the press piece strip and between the press piece strip and the front portion of the casing unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
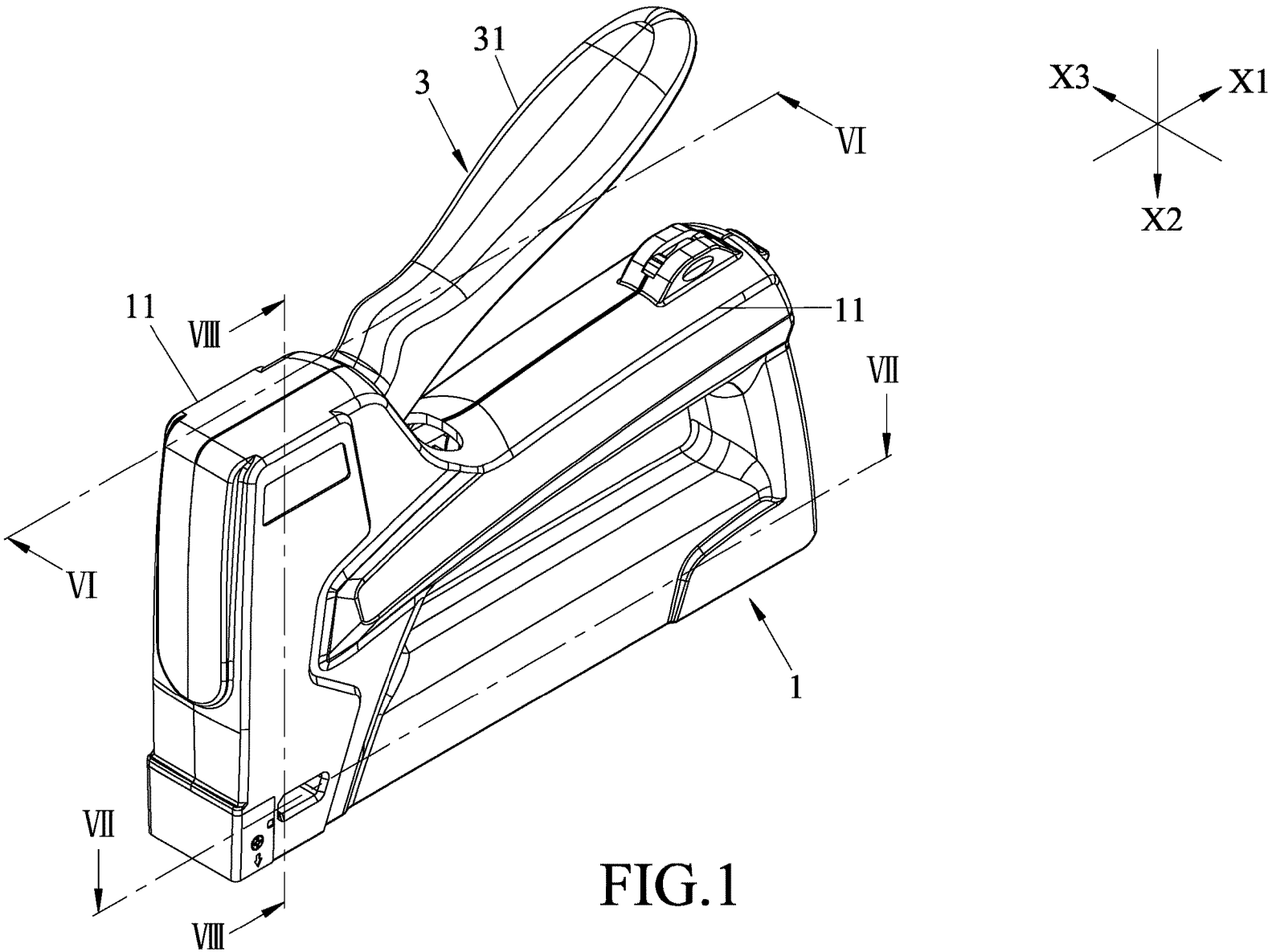
FIG. 1 is a perspective view illustrating an embodiment of a staple gun according to the disclosure.
Figure 2:
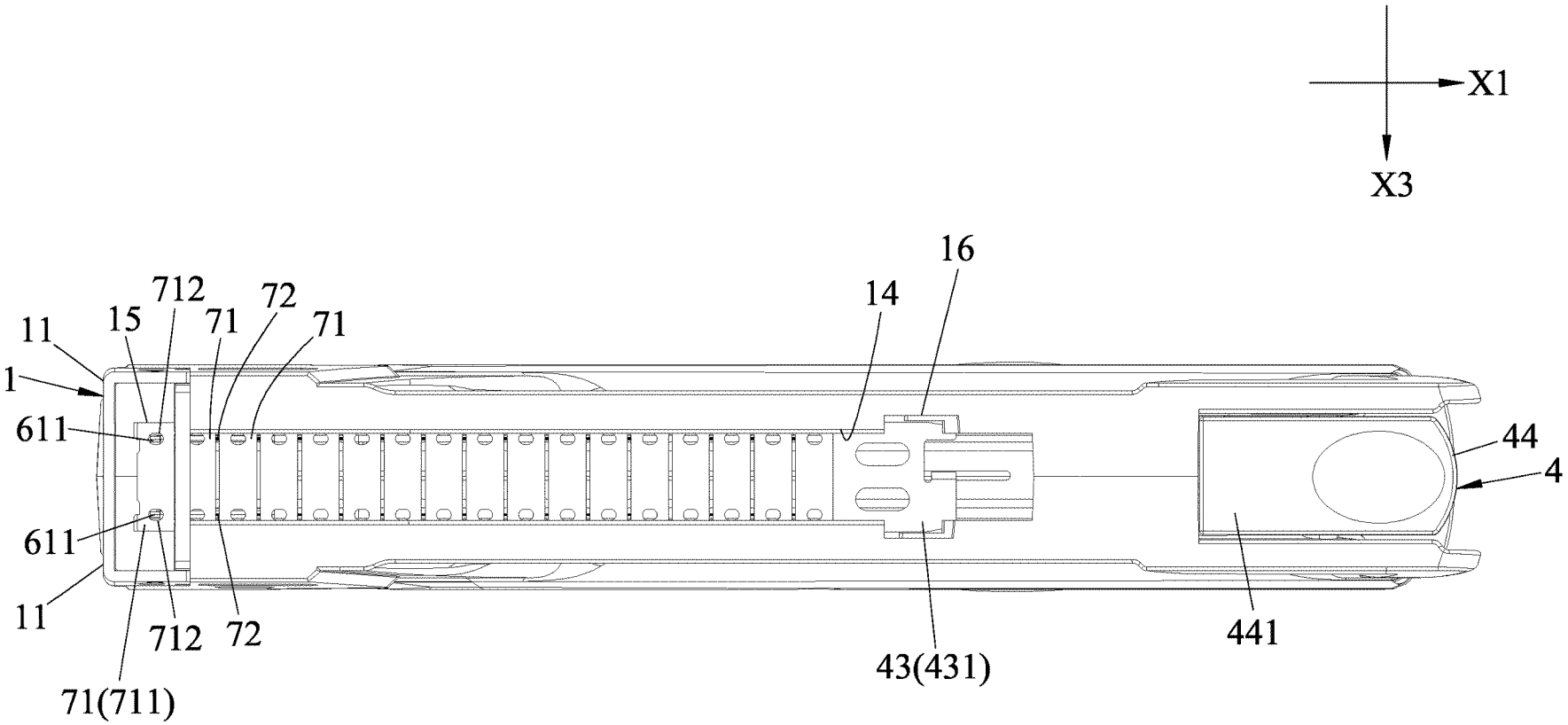
FIG. 2 is a bottom view of the embodiment.
Figure 3:
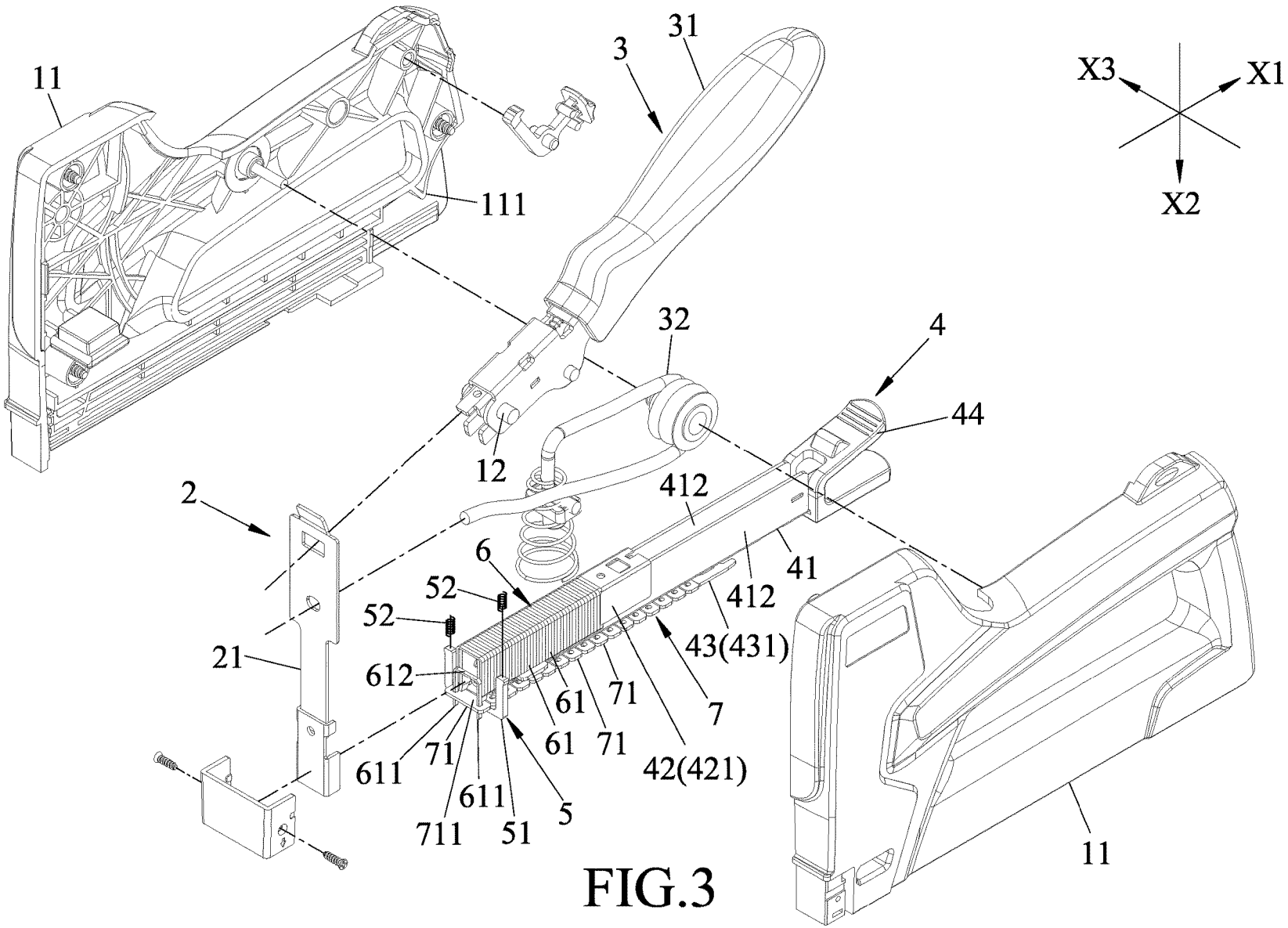
FIG. 3 is a partly exploded perspective view of the embodiment.

Referring to FIGS. 1 to 3, an embodiment of a staple gun according to the disclosure is adapted for use with a staple strip 6 and a press piece strip 7, and includes a casing unit 1, a striker unit 2, a handle unit 3, a loading unit 4 and a separating unit 5.

Specifically, the staple strip 6 includes a plurality of staples 61, and the press piece strip 7 includes a plurality of press pieces 71. The staple gun is adapted for driving out a frontmost staple 61 of the staple strip 6 and a frontmost press piece 71 of the press piece strip 7 simultaneously.

The staples 61 of the staple strip 6 are lined up and connected in a front-rear direction (X1). Each of the staples 61 has two staple legs 611 that are spaced apart in a left-right direction (X3) which is perpendicular to the front-rear direction (X1), and a staple crown 612 that interconnects the staple legs 611.

The press pieces 71 of the press piece strip 7 are lined up in the front-rear direction (X1), and the press piece strip 7 further has a plurality of connecting strings 72 that interconnect the press pieces 71. Each of the press pieces 71 has a main body 711 and two through holes 712 that extend through the main body 711 in a top-bottom direction (X2) which is perpendicular to the front-rear and left-right directions (X1, X3), and that are spaced apart in the left-right direction (X3) for the staple legs 611 of a corresponding one of the staples 61 to extend respectively therethrough.

It should be noted that, in this embodiment, each of the staples 61 is inverted U-shaped and provided with two staple legs 611. However, in other embodiments of the disclosure, each of the staples 61 may be T-shaped with only one staple leg 611, and each of the press pieces may have only one through hole 712 for the staple leg 611 to extend therethrough.

Figure 6:
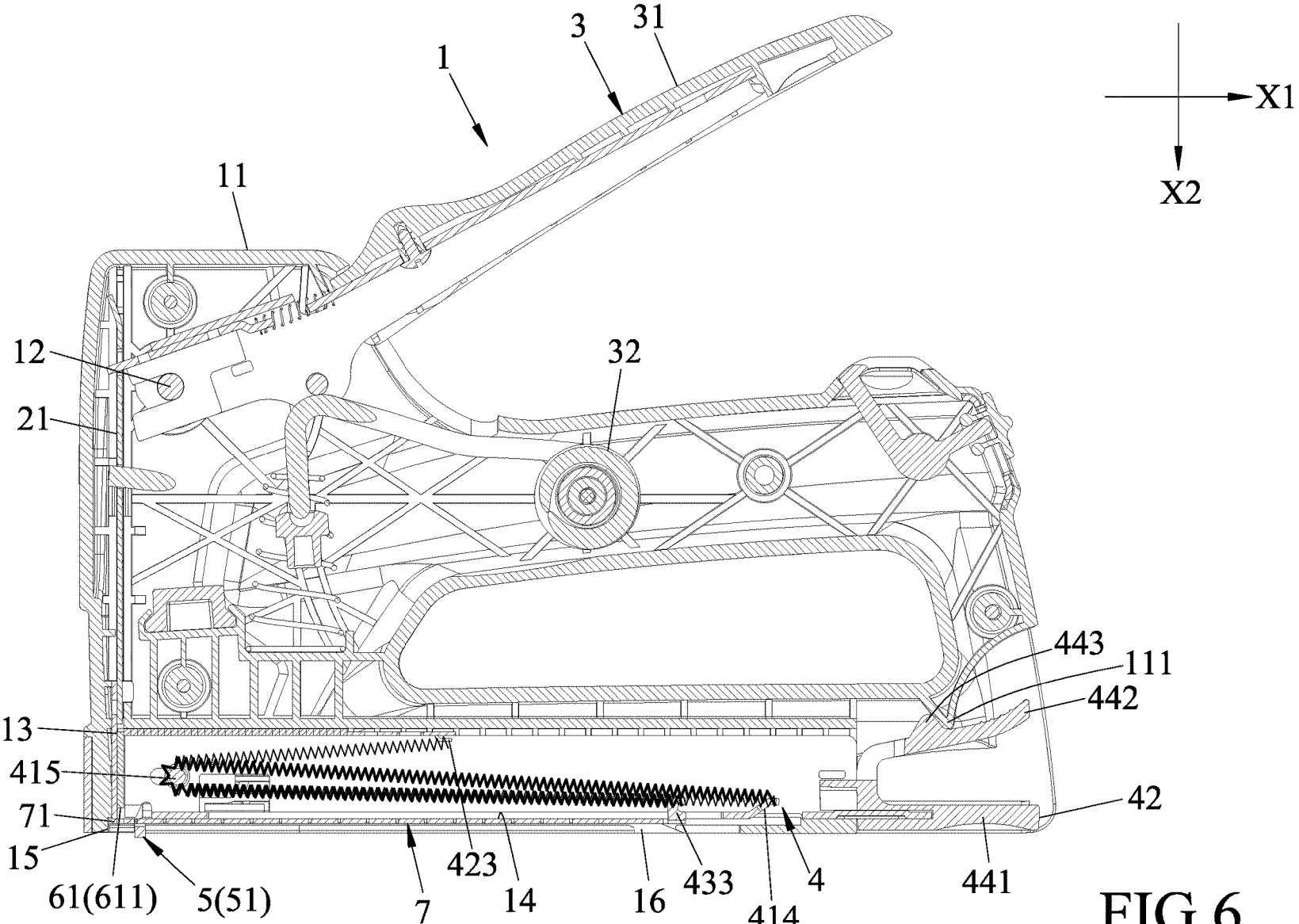
FIG. 6 is a sectional view taken along line VI-VI of FIG. 1.

Referring to FIGS. 3 and 6, the casing unit 1 of the staple gun includes two casing halves 11 that are coupled in the left-right direction (X3), and a pivot shaft 12 that extends in the left-right direction (X3) and that is rotatably connected between the casing halves 11. The casing halves 11 of the casing unit 11 cooperatively define a staple room 13, a press piece room 14, an exit opening 15 and a feeding opening 16.

The staple room 13 is elongated in the front-rear direction (X1), and is adapted for receiving the staple strip 6 such that the frontmost staple 61 abuts against a front portion of the casing unit 1. The press piece room 14 is elongated in the front-rear direction (X1), is disposed under and in spatial communication with the staple room 13, and is adapted for receiving the press piece strip 7 such that the frontmost press piece 71 abuts against the front portion of the casing unit 1 and is disposed under the frontmost staple 61.

The exit opening 15 is formed at a bottom end of the casing unit 1, is in spatial communication with the press piece room 14, and is adapted to be disposed under the frontmost press piece 71. The feeding opening 16 is formed at the bottom end of the casing unit 1, is in spatial communication with the press piece room 14, and is spaced apart from the exit opening 15.

The width of the feeding opening 16 in the left-right direction (X3) is adapted to be greater than the width of the press piece strip 7 in the left-right direction (X3) such that the press piece strip 7 is allowed to be loaded into the press piece room 14 via the feeding opening 16.

The striker unit 2 of the staple gun includes a hammer 21 that is movably mounted to the casing unit 1, and that is adapted for striking the frontmost staple 61 and the frontmost press piece 71 out of the casing unit 1 through the exit opening 15.

The handle unit 3 of the staple gun is mounted to the casing unit 1, and is operable to drive the striker unit 2. Specifically, the handle unit 3 includes a handle grip 31 that is co-rotatably connected to the pivot shaft 12, and a resilient spring set 32 that is mounted to the casing unit 1 and that is connected between the handle grip 31 and the hammer 21. Since operational details regarding the process of the handle unit 3 driving the striker unit 2 are well known to one of ordinary skill in the art, they will not be further described hereinafter.

Referring to FIGS. 4 to 8, the loading unit 4 of the staple gun includes a staple holder 41, a staple pushing subunit 42, a press piece pushing subunit 43 and a releasing subunit 44.

The staple holder 41 is received in the staple room 13, and has two side walls 412, a bottom wall 411, a sliding slot 413, a connecting member 414 and a pulley member 415.

The side walls 412 are elongated in the front-rear direction (X1) and are opposite to each other in the left-right direction (X3). The bottom wall 411 is elongated in the front-rear direction (X1), is connected between the side walls 412, and has front and rear ends 416, 417 that are opposite to each other in the front-rear direction (X1). The sliding slot 413 extends through the bottom wall 411 in the top-bottom direction (X2), and is elongated in the front-rear direction (X1).

The connecting member 414 is disposed at the rear end 417 of the bottom wall 411, and has two hook portions 418. The pulley member 415 extends through the side walls 412 in the left-right direction (X3), is proximate to the front end 416 of the bottom wall 411, and has two annular grooves 419.

It should be noted that, when the staple holder 41 is fully received in the staple room 13 of the casing unit 1, the feeding opening 16 of the casing unit 1 is disposed between the rear end 417 of the bottom wall 411 and the front portion of the casing unit 1, and is adjacent to the rear end 417 of the bottom wall 411.

Figure 4:
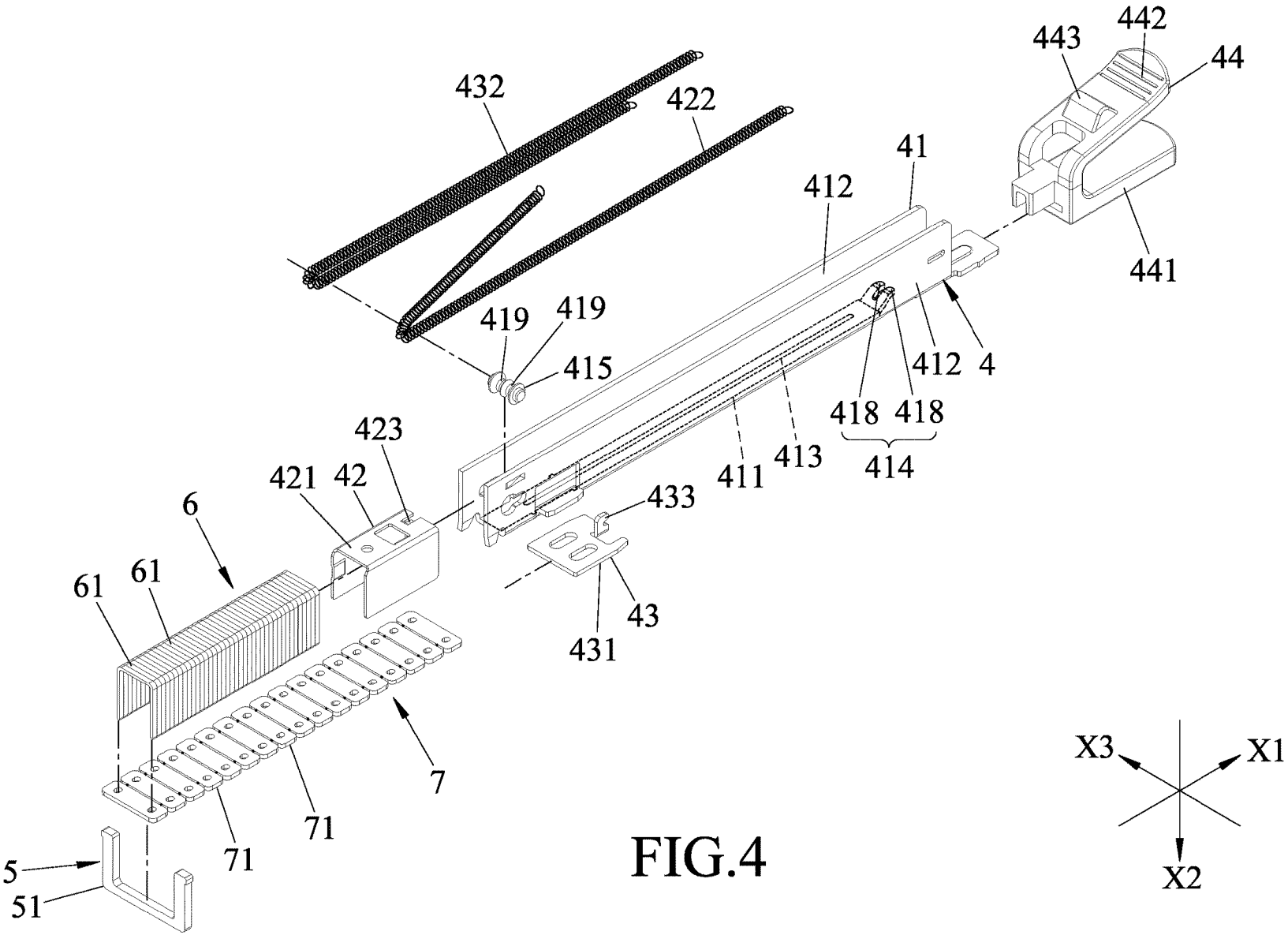
FIG. 4 is an exploded perspective view, illustrating a staple strip, a press piece strip, a loading unit and a part of a separating unit of the embodiment.
Figure 5:
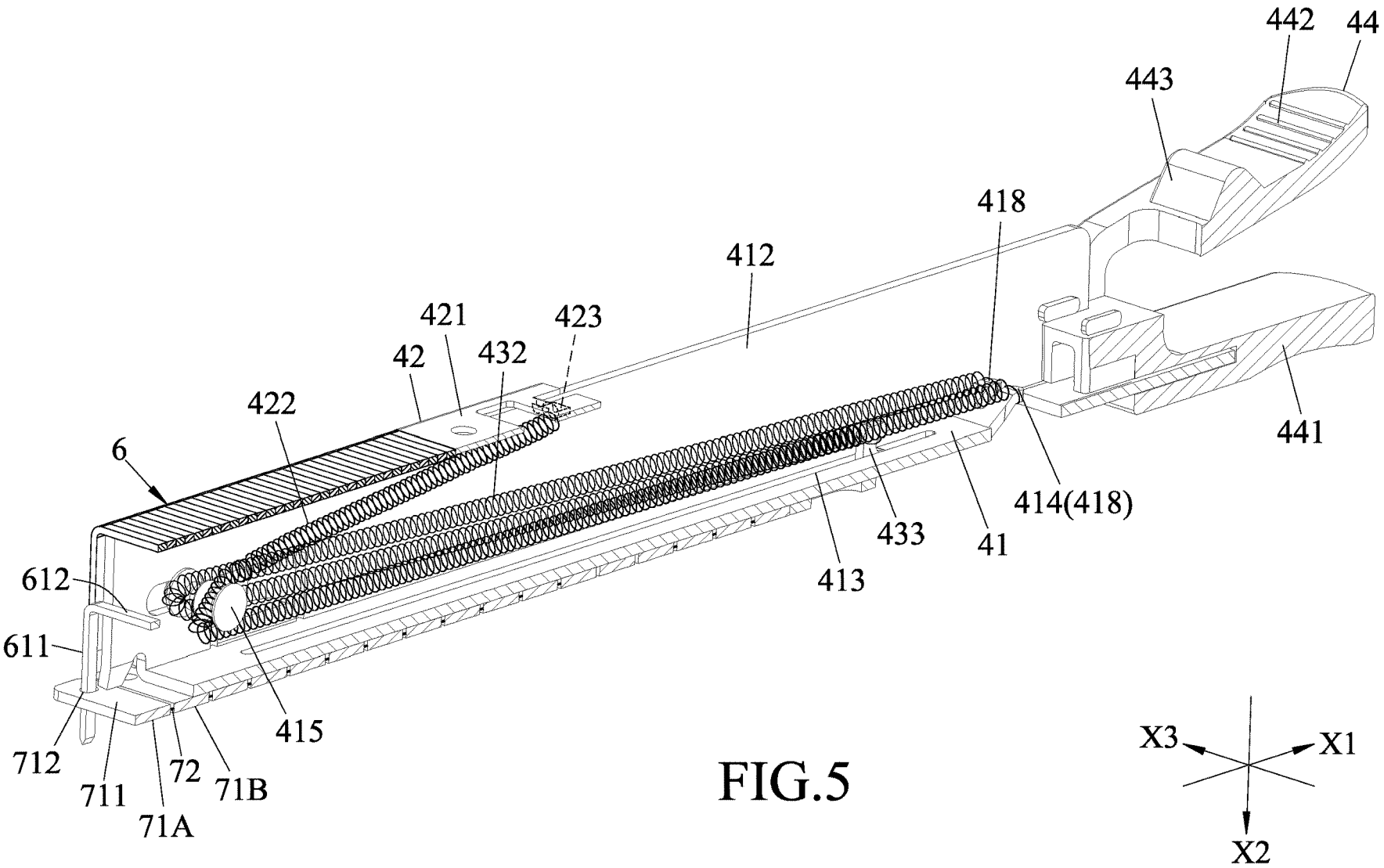
FIG. 5 is a fragmentary cutaway view of the embodiment.

Referring specifically to FIGS. 4 and 5, the staple pushing subunit 42 of the loading unit 4 includes a staple pusher 421 and a staple spring 422.

The staple pusher 421 is mounted to the staple holder 41, is movable relative to the staple holder 41 along the front-rear direction (X1), and is adapted to abut against a rear end of the staple strip 6 (see FIG. 3). The staple spring 422 has opposite ends that are respectively connected to the staple pusher 421 and the connecting member 414 of the staple holder 41. Specifically, the staple pusher 421 has a staple spring hook 423. One end of the staple spring 422 is hooked to the staple spring hook 423 of the staple pusher 421, and the other end of the staple spring 422 is hooked to one of the hook portions 418 of the connecting member 414 of the staple holder 41.

The staple spring 422 extends around the pulley member 415 and is movably received in one of the annular grooves 419 of the pulley member 415, such that the staple spring 422 exerts a biasing force onto the staple pusher 421, thereby maintaining contact between the staple pusher 421 and the staple strip 6, and contact between the frontmost staple 61 and the front portion of the casing unit 1.

The press piece pushing subunit 43 of the loading unit 4 includes a press piece pusher 431 and a press piece spring 432.

The press piece pusher 431 is mounted to the bottom wall 411 of the staple holder 41, is movable relative to the staple holder 41 along the front-rear direction (X1), and is adapted to abut against a rear end of the press piece strip 7 (see FIG. 3). The press piece spring 432 has opposite ends that are respectively connected to the press piece pusher 431 and the connecting member 414 of the staple holder 41. Specifically, the press piece pusher 431 has a press piece spring hook 433. One end of the press piece spring 432 is hooked to the press piece spring hook 433, and the other end of press piece spring 432 is hooked to the other one of the hook portions 418 of the connecting member 414 of the staple holder 41.

The press piece spring 432 extends around the pulley member 415 and is movably received in the other one of the annular grooves 419 of the pulley member 415, such that the press piece spring 432 exerts a biasing force onto the press piece pusher 431, thereby maintaining contact between the press piece pusher 431 and the press piece strip 7 and contact between the press piece strip 7 and the front portion of the casing unit 1.

It should be noted that, in this embodiment, the staple pusher 421 and the press piece pusher 431 are mounted respectively to two sides of the stapler holder 41 that are opposite in the top-bottom direction (X2).

The releasing subunit 44 of the loading unit 4 includes a fixed arm 441, a rotary arm 442 and a protruding portion 443. The rotary arm 442 is connected to the fixed arm 441 and is rotatable relative to the fixed arm 441. The protruding portion 443 is connected to the rotary arm 442 for abutting against the casing unit 1. Specifically, one of the casing halves 11 of the casing unit 1 is formed with a stopping portion 111 so that, when the staple holder 41 of the loading unit 4 is fully received in the staple room 13 of the casing unit 1, the protruding portion 443 of the releasing subunit 44 abuts against the stopping portion 111 (see FIG. 6), such that the loading unit 4 is prevented from moving in the front-rear direction (X1) relative to the casing unit 1.

On the other hand, when an external force is exerted on the rotary arm 442 such that the rotary arm 442 rotates towards the fixed arm 441, the protruding portion 443 is moved away from the stopping portion 111 of the casing unit 1, thereby allowing the loading unit 4 to move in the front-rear direction (X1) relative to the casing unit 1 for loading of the staple strip 6 and the press piece strip 7.

Figure 7:
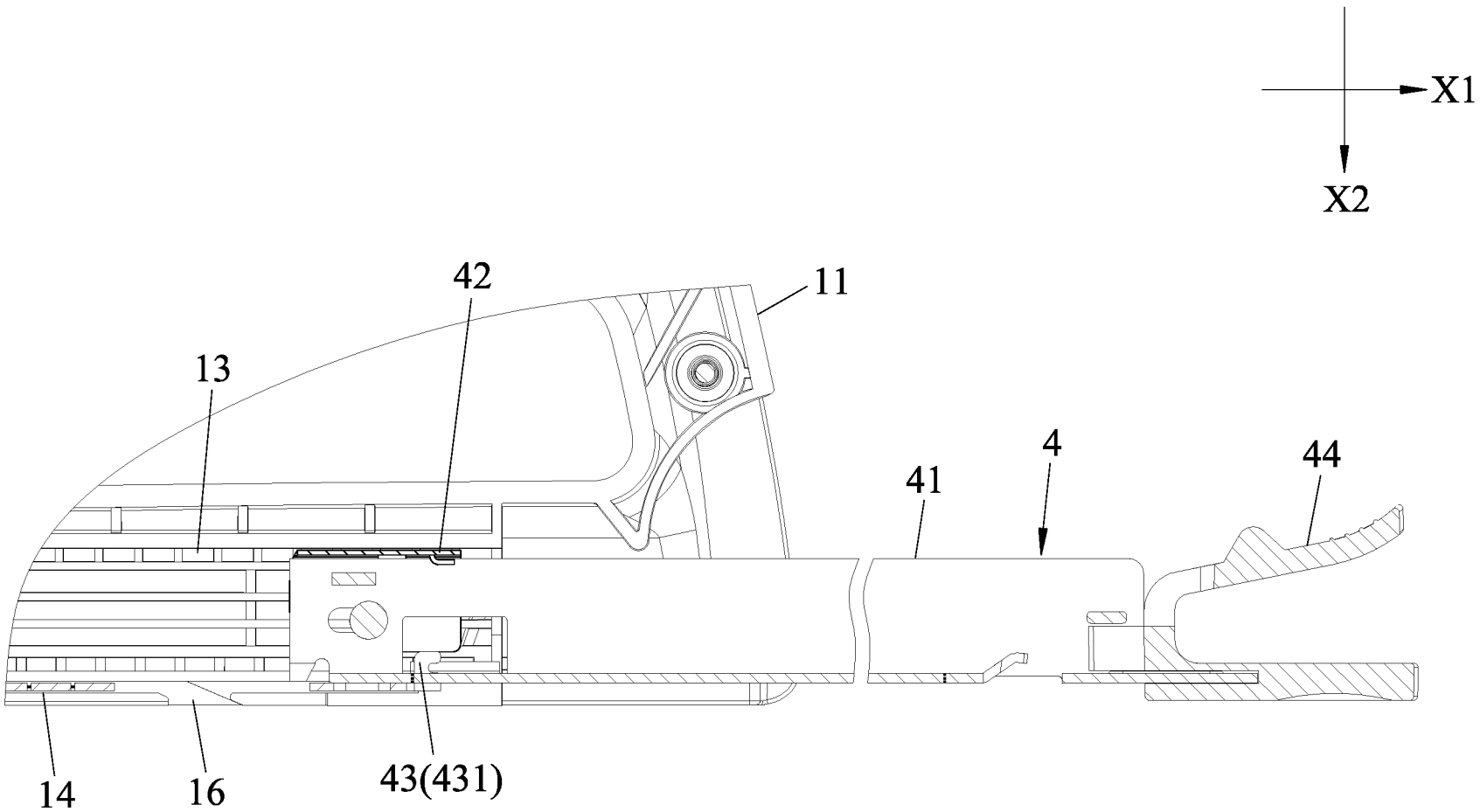
FIG. 7 is a fragmentary sectional view of the embodiment.
Figure 8:
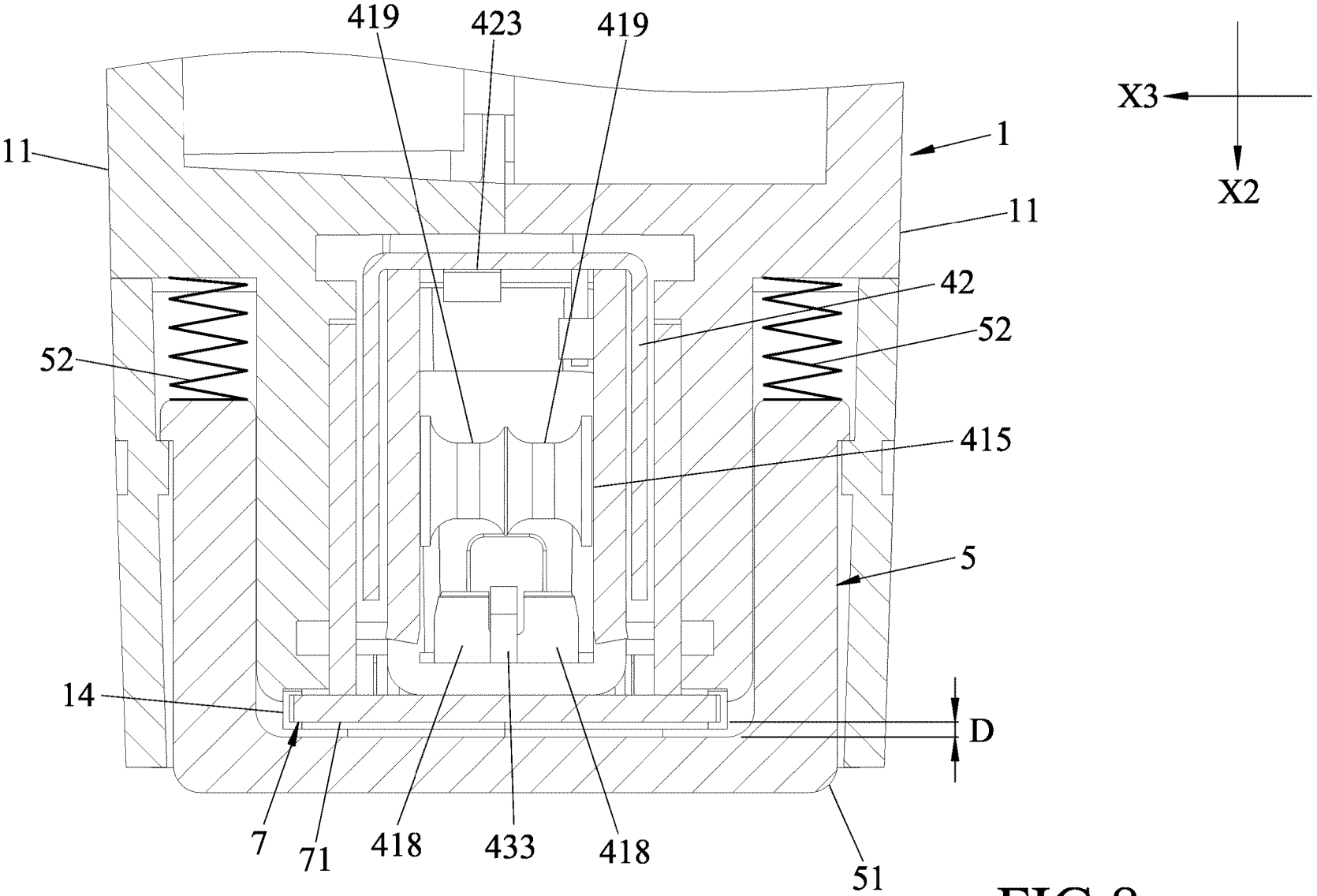
FIG. 8 is a fragmentary sectional view taken along line VIII-VIII of FIG. 1, with a staple spring and a press piece spring omitted therefrom.

It should be noted that, to load the press piece strip 7, the loading unit 4 needs to be moved to a position where the feeding opening 16 is disposed between the front portion of the casing unit 1 and the press piece pusher 431 of the press piece pushing subunit 43 (see FIG. 7). However, to load the staple strip 6 alone, the loading unit 4 only needs to be moved to a position where the length of a exposed portion of the staple holder 41 is greater than or equal to the length of the staple strip 6.

Referring to FIG. 8 and FIGS. 9A to 9D, the separating unit 5 of the staple gun is mounted to the casing unit 1, and includes a separating member 51, and two spaced-apart resilient members 52.

The separating member 51 is disposed proximally to the exit opening 15, and is adapted to cooperate with the staple holder 41 for clamping a succeeding press piece 71 of the press piece strip 7 therebetween during striking operation of the striker unit 2 performed on the frontmost press piece 71, thereby resulting in separation of the frontmost press piece 71 from the succeeding press piece 71.

The resilient members 52 are spaced apart from each other in the left-right direction (X3), and each of the resilient members 52 is disposed between the casing unit 1 and the separating member 51 for biasing the separating member 51 away from the casing unit 1.

The following paragraphs describe an operation of the staple gun. For the sake of distinction, in FIGS. 9A to 9D, the frontmost staple 61 and the succeeding staple 61 are designated respectively as 61A and 61B, and the frontmost press piece 71 and the succeeding press piece 71 are designated respectively as 71A and 71B. In addition, the broken line shown in each of FIGS. 9A to 9D depicts a contact surface (e.g., a surface of apiece of paper) with which the staple gun makes contact during the operation.

Figure 9A:
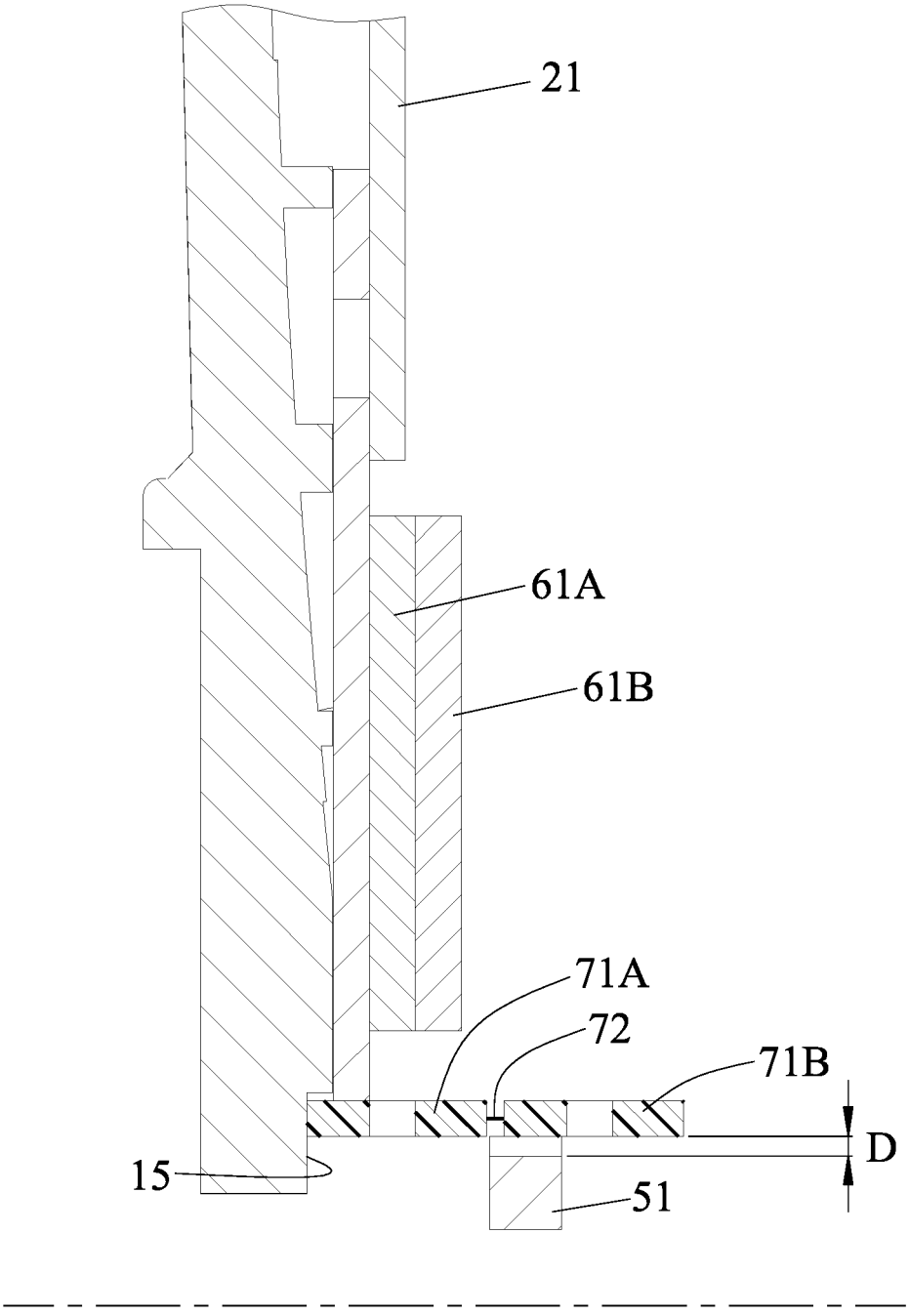
FIGS. 9A to 9D are fragmentary sectional views of the embodiment, illustrating a striking operation.
Figure 9B:
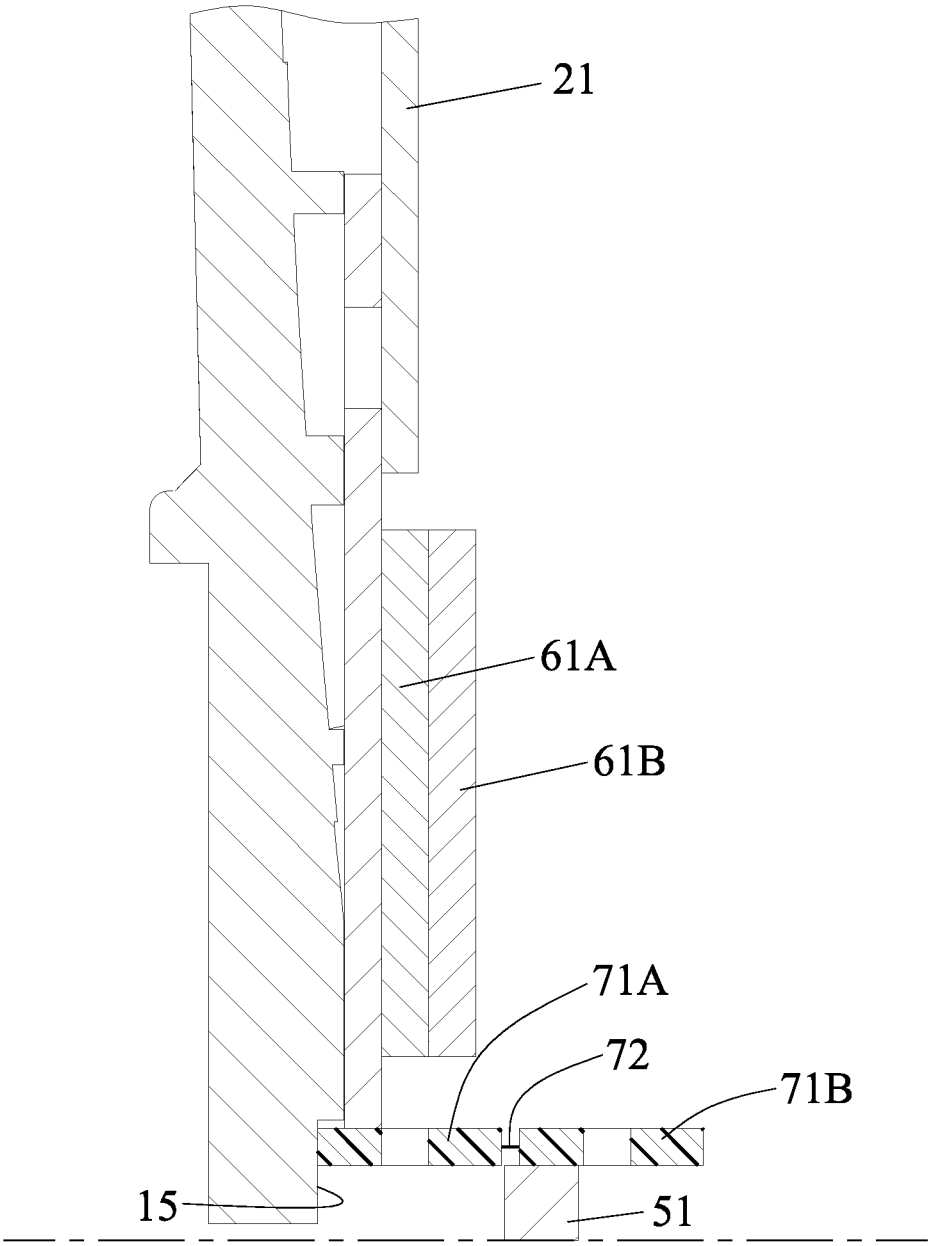
Figure 9C:
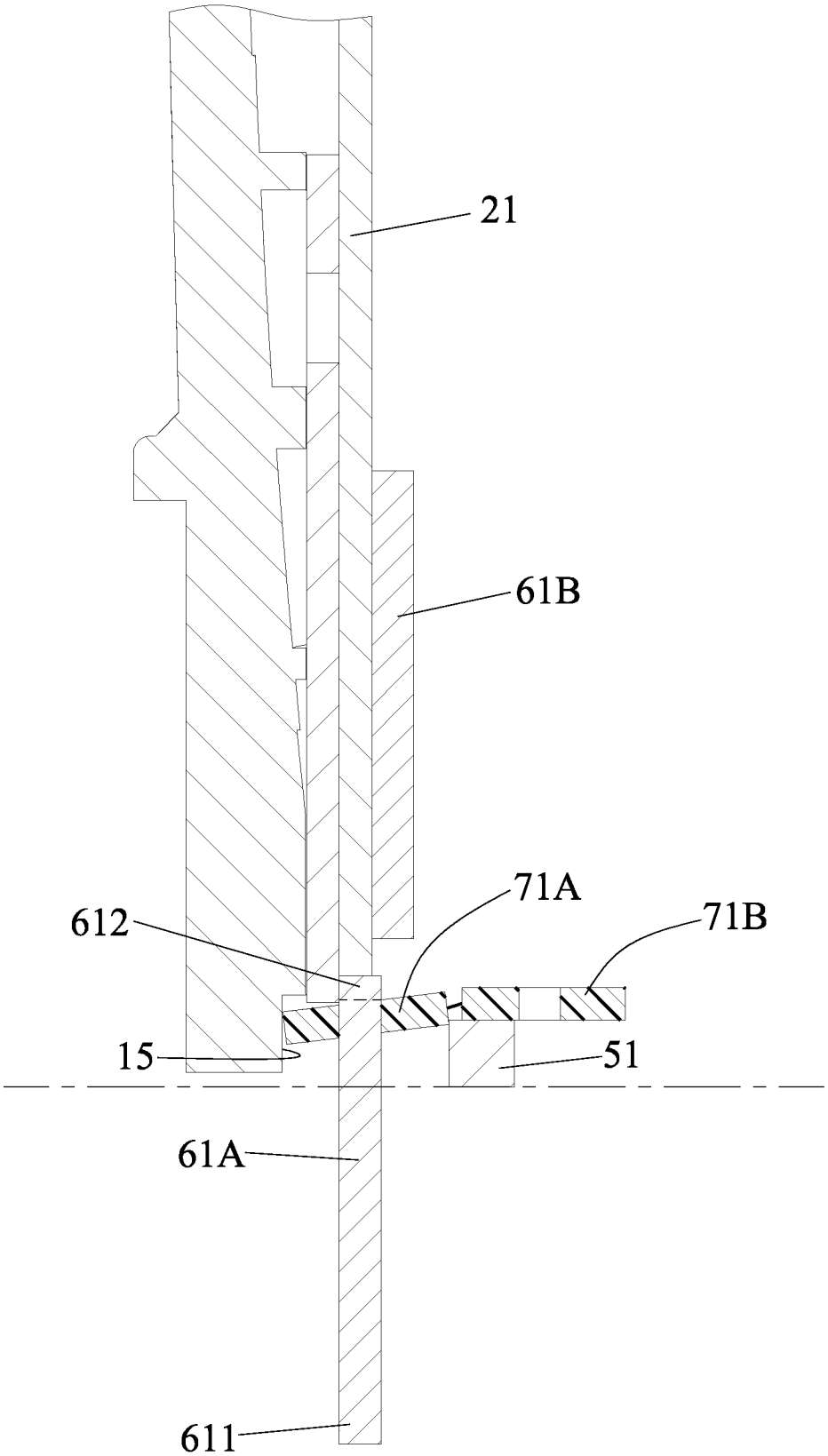
Figure 9D:
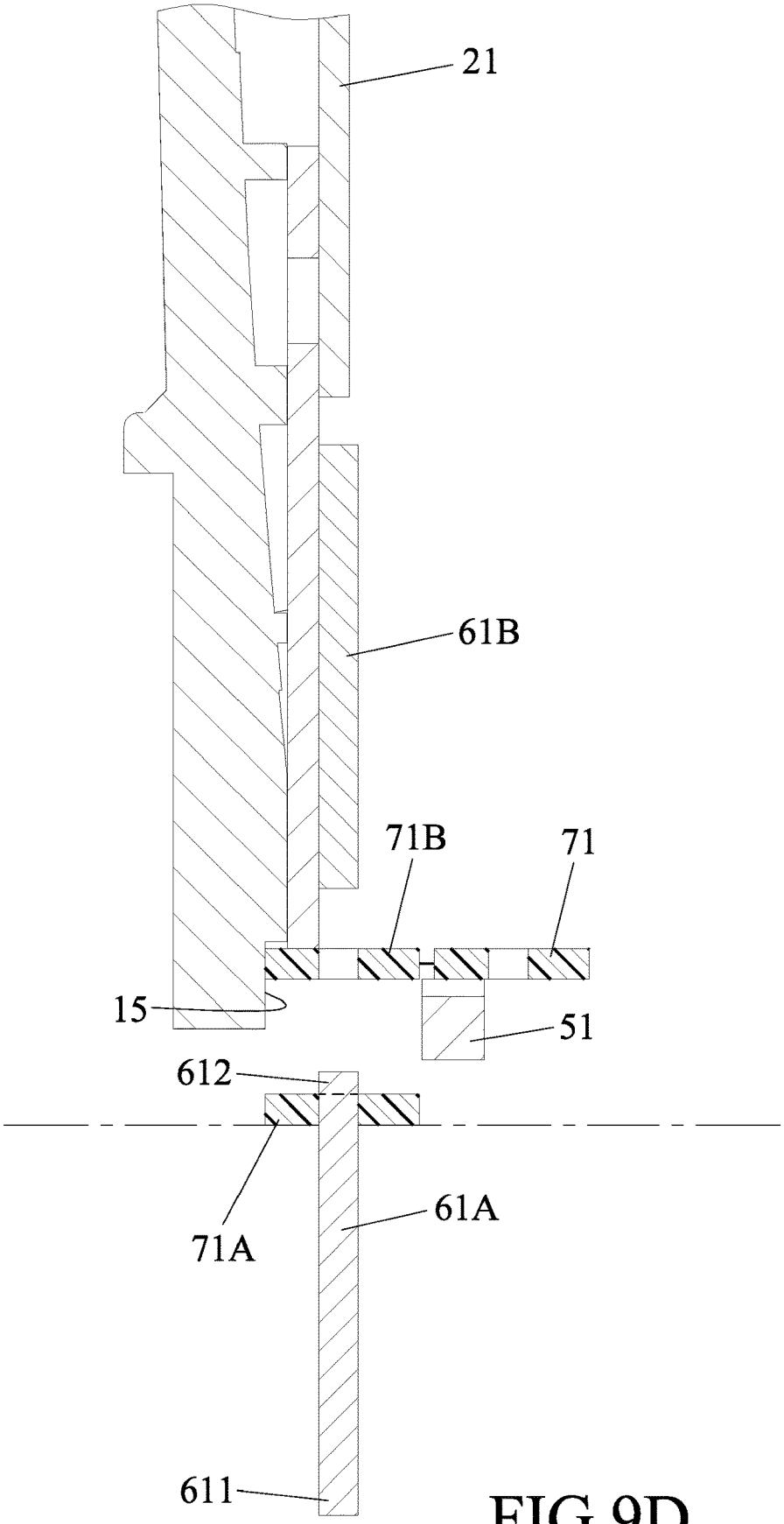

Prior to the operation, the separating member 51 of the separating unit 5 is spaced apart from the succeeding press piece 71B by a distance (D) (see FIG. 9A). To start the operation, the user first presses the staple gun against the contact surface such that the separating member 51 is forced by the contact surface to abut against the succeeding press piece 71B (see FIG. 9B).

Next, when the user operates on the handle unit 3, the striker unit 2 is driven to perform the abovementioned striking operation on the frontmost staple 61A and the frontmost press piece 71A. During this process, as the frontmost staple 61A is struck by the hammer 21 of the striker unit 2, the staple legs 611 extend respectively through the through holes 712 of the frontmost press piece 71A, and the staple crown 612 is pressed against the main body 711 of the frontmost press piece 71A, forcing the frontmost press piece 71A to move towards the contact surface (see FIG. 9C) to thereby exert a pulling force on the connecting strings 72 of the press pieces strip 7.

At this time, since the succeeding press piece 71B is clamped between the separating member 51 and the staple holder 41 and is temporally immovable, the connecting strings 72 disposed between the frontmost press piece 71A and the succeeding press piece 71B are broken, allowing the frontmost staple 61A to further move through the contact surface while pressing the frontmost press piece 71A fully against the contact surface and thus completing the striking operation.

After that, the hammer 21 is pulled back to its original position prior to the operation, allowing the succeeding staple 61B, which is pushed indirectly by the staple pusher 421, to move forward to abut against the front portion of the casing unit 1. Moreover, once the staple gun is pulled away from the contact surface, the separating member 51 is biased away from the casing unit 1 by the resilient members 52 and in turn releases the succeeding press piece 71B. As a result, the succeeding press piece 71B, which is pushed indirectly by the press piece pusher 431, also moves forward to abut against the front portion of the casing unit 1, and the staple gun is now ready for the next operation.

Figure 10:
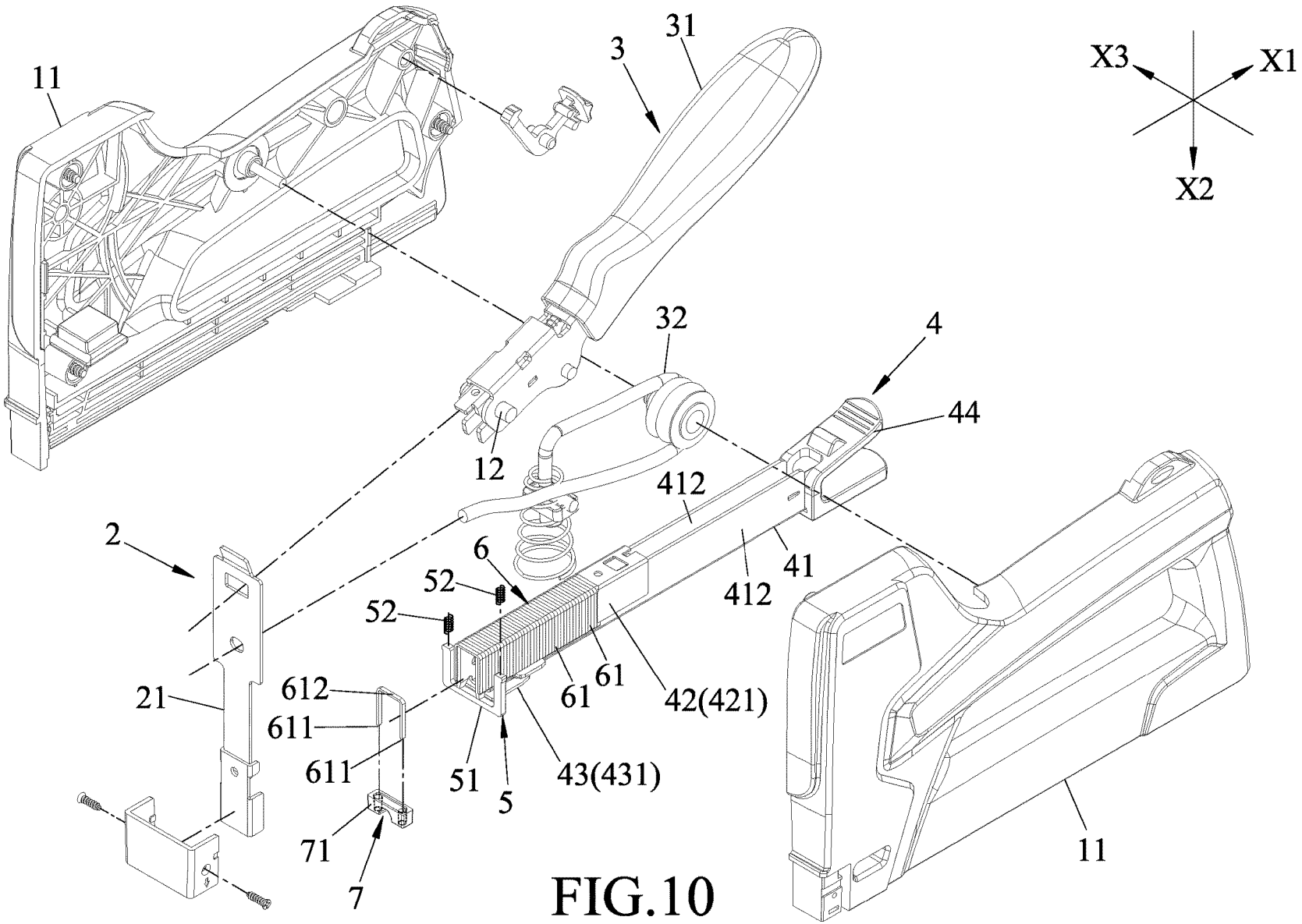
FIG. 10 is partly exploded perspective view of a variation of the embodiment.
Figure 11:
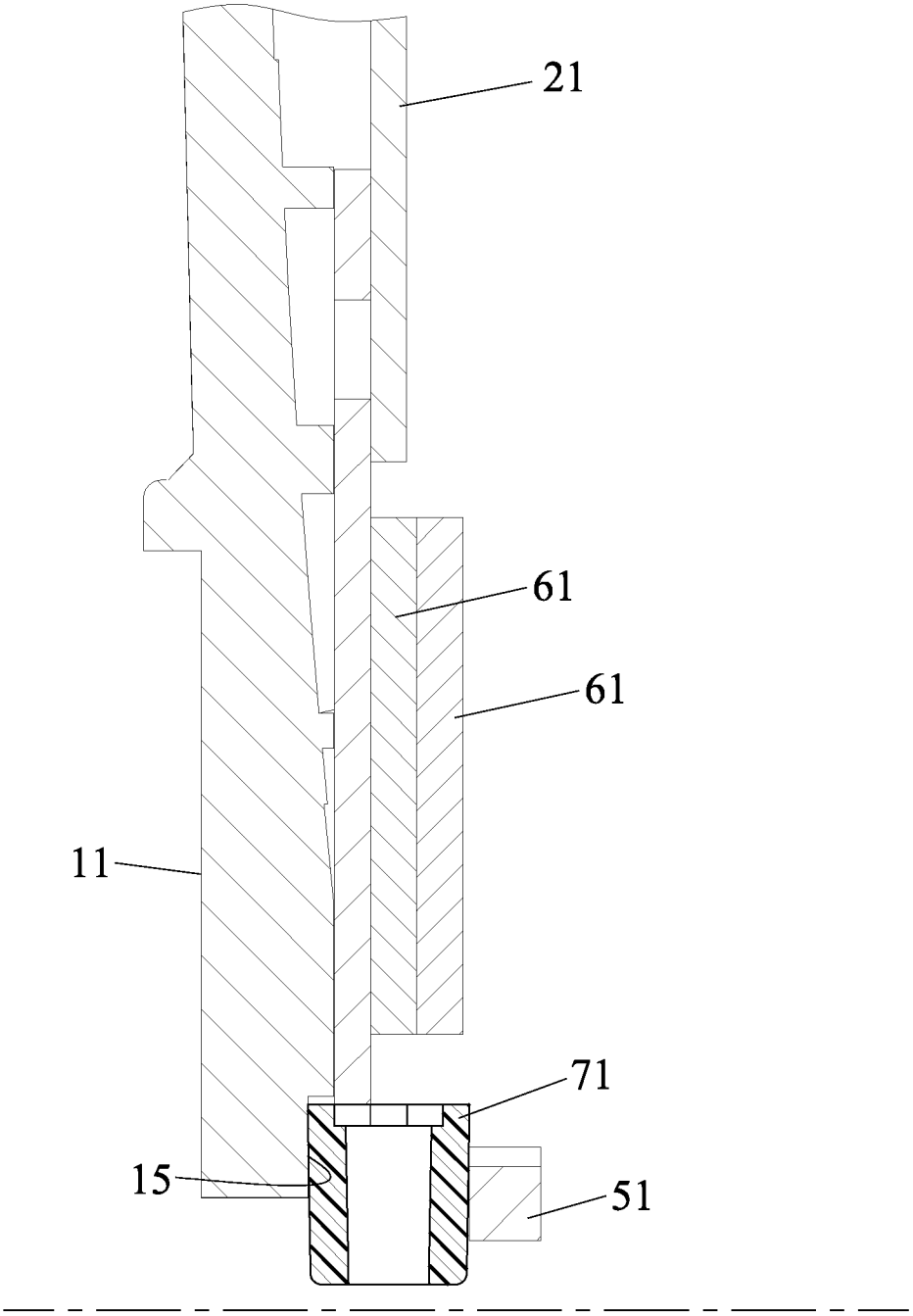
FIG. 11 is a fragmentary sectional view of the variation of the embodiment.
Figure 12:
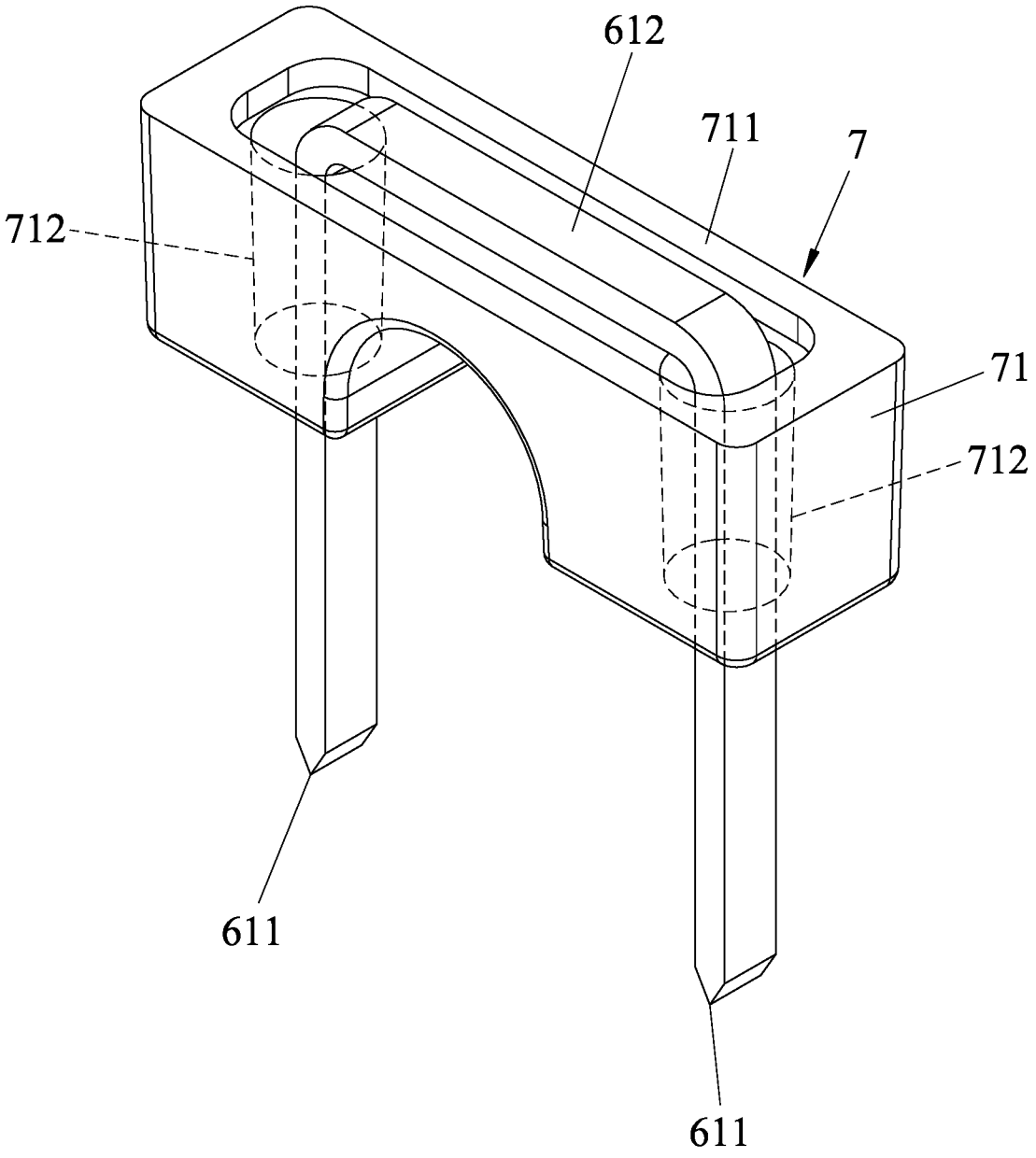
FIG. 12 is a perspective view of a staple and a press piece of the variation of the embodiment.

Referring to FIGS. 10 to 12, it should be noted that the press pieces 71 of the press piece strip 7 are not limited to the abovementioned configuration; in a variation of the present embodiment, each of the press pieces 71 has a thicker main body 711 which is inverted U-shaped.

During the operation of the staple gun in this variation, only one of the press pieces 71 can be loaded, and the one of the press pieces 71 is disposed between the front portion of the casing unit 1 and the separating member 51 of the separating unit 5. Specifically, as shown in FIG. 11, the one of the press pieces 71 is clamped between an inner surface of one of the casing halves 11 of the casing unit 1 and a side surface of the separating member 51. In addition, as shown in FIG. 12, each of the press pieces 71 has two through holes 712 provided for the staple legs 611 of a corresponding one of the staples 61 to extend respectively therethrough.

In summary, the embodiment of the staple gun according to the disclosure has advantages as follows.

Firstly, since the press pieces 71 provide a greater contact area than that of the staples 61, the embodiment is able to perform better effect than the prior art in holding pieces of paper on the wall. That is, corners of the paper are less likely to be removed from the wall by wind since a greater portion thereof is being pressed against the wall.

Secondly, in addition to facilitating the separation of the frontmost press piece 71 from the succeeding press piece 71, the separating member 51 also prevents the succeeding press piece 71 from being pulled by the frontmost press piece 71 to move through the exit opening 15. Moreover, disposition of the resilient members 52 enables the separating member 51 to quickly return to its pre-operation position, thereby ensuring smooth transition of the succeeding press piece 71 for the next operation.

Finally, since the feeding opening 16 has a width greater than that of the press piece strip 7 and since the press piece pusher 431 is able to be moved to the position (see FIG. 7) where the press piece room 14 and the feeding opening 16 are clear of obstruction, the user can load the press piece strip 7 into the press piece room 14 of the staple gun with ease.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A staple gun adapted for driving out a frontmost staple of a staple strip and a frontmost press piece of a press piece strip simultaneously, said staple gun comprising:

a casing unit defining a staple room that is elongated in a front-rear direction, and that is adapted for receiving the staple strip such that the frontmost staple abuts against a front portion of said casing unit, a press piece room that is elongated in the front-rear direction, that is disposed under and in spatial communication with said staple room, and that is adapted for receiving the press piece strip such that the frontmost press piece abuts against said front portion of said casing unit and is disposed under the frontmost staple, and an exit opening that is formed at a bottom end of said casing unit, that is in spatial communication with said press piece room, and that is adapted to be disposed under the frontmost press piece;

a striker unit movably mounted to said casing unit, and adapted for striking the frontmost staple and the frontmost press piece out of said casing unit through said exit opening;

a handle unit mounted to said casing unit, and being operable to drive said striker unit; and a loading unit including a staple holder that is received in said staple room, and that has two side walls being elongated in the front-rear direction and being opposite to each other in a left-right direction perpendicular to the front-rear direction, a bottom wall being elongated in the front-rear direction, being connected between said side walls, and having front and rear ends that are opposite to each other in the front-rear direction, a connecting member disposed at said rear end of said bottom wall, and a pulley member extending through said side walls in the left-right direction, and being proximate to said front end of said bottom wall, a staple pushing subunit that includes a staple pusher mounted to said staple holder, being movable relative to said staple holder along the front-rear direction, and adapted to abut against a rear end of the staple strip, and a staple spring having opposite ends that are respectively connected to said staple pusher and said connecting member of said staple holder, and extending around said pulley member such that said staple spring exerts a biasing force onto said staple pusher, thereby maintaining contact between said staple pusher and the staple strip and between the frontmost staple and said front portion of said casing unit, and a press piece pushing subunit that includes a press piece pusher mounted to said bottom wall of said staple holder, being movable relative to said staple holder along the front-rear direction, and adapted to abut against a rear end of the press piece strip, and a press piece spring having opposite ends that are respectively connected to said press piece pusher and said connecting member of said staple holder, and extending around said pulley member such that said press piece spring exerts a biasing force onto said press piece pusher, thereby maintaining contact between said press piece pusher and the press piece strip and between the press piece strip and said front portion of said casing unit.

2. The staple gun as claimed in claim 1, wherein:

said connecting member has two hook portions, said staple spring and said press piece spring being respectively hooked to said hook portions; and said pulley member has two annular grooves, said staple spring and said press piece spring being respectively and movably received in said annular grooves.

3. The staple gun as claimed in claim 1, wherein:

said staple pusher has a staple spring hook, said staple spring being hooked to said staple spring hook; and said press piece pusher has a press piece spring hook, said press piece spring being hooked to said press piece spring hook.

4. The staple gun as claimed in claim 1, wherein said staple pusher and said press piece pusher are mounted respectively to two sides of said stapler holder that are opposite in a top-bottom direction.

5. The staple gun as claimed in claim 1, wherein:

said casing unit further defines a feeding opening that is formed at said bottom end of said casing unit, and that is in spatial communication with said press piece room;

a width of said feeding opening in the left-right direction is adapted to be greater than a width of the press piece strip in the left-right direction; and said feeding hole is disposed between said rear end of said bottom wall of said staple holder and said front portion of said casing unit, and is adjacent to said rear end of said bottom wall.

6. The staple gun as claimed in claim 1, further comprising a separating unit that is mounted to said casing unit, and that includes a separating member disposed proximally to said exit opening, said separating member being adapted to cooperate with said staple holder for clamping a succeeding press piece therebetween during striking operation of said striker unit performed on the frontmost press piece, thereby resulting in separation of the frontmost press piece from the succeeding press piece.

7. The staple gun as claimed in claim 6, wherein said separating unit further includes two spaced-apart resilient members, each of which is disposed between said casing unit and said separating member for biasing said separating member away from said casing unit.

* * * * *